US007000692B2

(12) United States Patent
Hosie et al.

(10) Patent No.: US 7,000,692 B2
(45) **Date of Patent: *Feb. 21, 2006**

(54) APPARATUS AND METHODS FOR PLACING DOWNHOLE TOOLS IN A WELLBORE

(75) Inventors: David Hosie, Sugar Land, TX (US); Thomas Roesnor, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/848,337

(22) Filed: May 18, 2004

(65) Prior Publication Data

US 2004/0221986 A1 Nov. 11, 2004

Related U.S. Application Data

(63) Continuation of application No. 09/778,051, filed on Feb. 6, 2001, now Pat. No. 6,736,210.

(51) Int. Cl.
*E21B 23/00* (2006.01)
*E21B 47/09* (2006.01)

(52) U.S. Cl. ..... 166/66; 166/255.1; 166/381

(58) Field of Classification Search ..... 166/254.2, 166/255.1, 255.2, 255.3, 66, 297, 55.1, 117.6, 166/50, 381
See application file for complete search history.

(56) References Cited

U.S. PATENT DOCUMENTS

| | | | |
|---|---|---|---|
| 2,470,743 | A | 5/1949 | Hochgesang et al. |
| 2,508,722 | A | 5/1950 | Loesser |
| 2,659,014 | A | 11/1953 | Scherbatskoy |
| 2,993,994 | A | 7/1961 | Herzog |
| 3,071,687 | A | 1/1963 | Youmans |
| 3,490,280 | A | 1/1970 | Fields |
| 3,566,682 | A | 3/1971 | Winkler, Jr. |
| 3,611,799 | A | 10/1971 | Davis |
| 3,831,138 | A | 8/1974 | Rammner |
| 4,226,116 | A | 10/1980 | Denison |
| 4,320,800 | A | 3/1982 | Upchurch |
| 4,459,480 | A | 7/1984 | Dimon |
| 4,510,797 | A | 4/1985 | Guidry et al. |
| 4,566,318 | A | 1/1986 | Rao et al. |
| 4,570,480 | A | 2/1986 | Fontenot et al. |
| 4,580,632 | A | 4/1986 | Reardon |
| 4,585,939 | A | 4/1986 | Arnold et al. |
| 4,628,202 | A | 12/1986 | Minette |
| 4,790,378 | A | 12/1988 | Montgomery et al. |
| 4,794,336 | A | 12/1988 | Marlow et al. |
| 4,883,956 | A | 11/1989 | Melcher et al. |

(Continued)

FOREIGN PATENT DOCUMENTS

| | | |
|---|---|---|
| EP | 0 921 269 | 6/1999 |

(Continued)

OTHER PUBLICATIONS

PCT International Search Report from International Application PCT/GB02/00240, Dated Jun. 27, 2002.

(Continued)

*Primary Examiner*—Hoang Dang
(74) *Attorney, Agent, or Firm*—Patterson & Sheridan LLP

(57) ABSTRACT

Methods and apparatus are provided that permit downhole tools to be run into a well along with logging tools that can log the downhole tools into place by real time transmission of the data to a surface location. In one aspect, an apparatus includes a telemetry tool, a logging tool in communication with the telemetry tool and a downhole tool.

7 Claims, 2 Drawing Sheets

U.S. PATENT DOCUMENTS

| | | | | |
|---|---|---|---|---|
| 4,898,236 | A | | 2/1990 | Sask |
| 5,010,764 | A | | 4/1991 | Taylor |
| 5,019,978 | A | | 5/1991 | Howard et al. |
| 5,081,351 | A | | 1/1992 | Roscoe et al. |
| 5,279,366 | A | * | 1/1994 | Scholes ..... 166/254.2 |
| 5,358,059 | A | | 10/1994 | Ho |
| 5,394,141 | A | | 2/1995 | Soulier |
| 5,410,152 | A | | 4/1995 | Gadeken |
| 5,488,989 | A | | 2/1996 | Leising et al. |
| 5,530,359 | A | | 6/1996 | Habashy et al. |
| 5,581,024 | A | | 12/1996 | Meyer, Jr. et al. |
| 5,635,631 | A | | 6/1997 | Yesudas et al. |
| 5,740,864 | A | | 4/1998 | De Hoedt et al. |
| 5,753,813 | A | | 5/1998 | Hagiwara |
| 5,799,733 | A | * | 9/1998 | Ringgenberg et al. ..... 166/264 |
| 5,829,520 | A | | 11/1998 | Johnson |
| 5,945,923 | A | | 8/1999 | Soulier |
| 6,041,860 | A | | 3/2000 | Nazzal et al. |
| 6,101,445 | A | | 8/2000 | Alvarado et al. |
| 6,114,972 | A | | 9/2000 | Smith |
| 6,173,773 | B1 | | 1/2001 | Almaguer et al. |
| 6,177,882 | B1 | | 1/2001 | Ringgenberg et al. |
| 6,218,959 | B1 | | 4/2001 | Smith |
| 6,247,542 | B1 | | 6/2001 | Kruspe et al. |
| 6,459,263 | B1 | | 10/2002 | Hawkes et al. |
| 6,464,011 | B1 | * | 10/2002 | Tubel ..... 166/313 |
| 6,516,663 | B1 | | 2/2003 | Wong |
| 6,520,264 | B1 | * | 2/2003 | MacKenzie et al. ..... 166/385 |
| 6,577,244 | B1 | * | 6/2003 | Clark et al. ..... 340/854.6 |
| 6,691,779 | B1 | * | 2/2004 | Sezginer et al. ..... 166/250.01 |
| 6,736,210 | B1 | * | 5/2004 | Hosie et al. ..... 166/254.2 |

FOREIGN PATENT DOCUMENTS

| | | | |
|---|---|---|---|
| EP | 0930518 | * | 7/1999 |
| FR | 2 621 072 | | 3/1989 |

OTHER PUBLICATIONS

PCT International Search Report from International Application PCT/GB02/00286, Dated Apr. 12, 2002.

Canadian Office Action, Application No. 2,431,288, dated Jul. 4, 2005.

* cited by examiner 107
125
130
105
110
115
100
120
135
141
140
145

125
107
130
205
210
215
220
250
200
255
260

APPARATUS AND METHODS FOR PLACING DOWNHOLE TOOLS IN A WELLBORE

CROSS-REFERENCE TO RELATED APPLICATIONS

This application is a continuation of U.S. patent application Ser. No. 09/778,051, filed Feb. 6, 2001, now U.S. Pat. No. 6,736,210. The aforementioned related patent application is herein incorporated by reference.

BACKGROUND OF THE INVENTION

1. Field of the Invention

The present invention generally relates to well completion. More specifically, the invention relates to placement of downhole tools in a wellbore using logging equipment run into the wellbore on a tubular string with the tools. Still more particularly, the invention relates to the use of wireless, real time communication between logging components run into well on a tubular string and the surface of the well.

2. Description of the Related Art

Hydrocarbon wells are formed by drilling an initial borehole in the earth and then lining the borehole with pipe or casing to form a wellbore. The casing prevents the walls of the wellbore from caving in and facilitates the isolation of certain parts of the wellbore. Subsequently, at least one area of the wellbore casing is perforated to permit communication with an oil bearing formation therearound. As the oil enters the perforated casing, it is typically collected in a separate tubular string used as a conduit to move the oil to the surface of the well.

In one example of well completion, a borehole is formed and casing is then run into the borehole. The casing is initially suspended from the surface of the well but is thereafter cemented into place with cement deposited in the annular area formed between the outer surface of the casing and the walls of the borehole. In order to access a formation of interest around the wellbore, a bridge plug may be installed in the wellbore below the area of interest. The bridge plug is run into the well on a tubular string and includes an outward radially extendable sealing element to contact and seal an area between the bridge plug and the casing wall. Bridge plugs can be set hydraulically or mechanically and their use is well known in the art. With the bridge plug set, a tubular string with a packer, a screened portion and a perforating gun are run into the well. When the perforating gun is adjacent the formation of interest, the packer is set. Packers, like bridge plugs include a radially extendable sealing element. Additionally, packers include a central bore with a sealing member therein to seal the area between the inner bore and the production tubing extending therethough. With the packer set and the area of the wellbore isolated, the perforating guns are fired and the casing and cement therearound are perforated. With the perforation, fluid communication is established between the formation fluids and the surface of the well via the production tubing. Additionally, the producing area of the wellbore is isolated from other areas.

The foregoing example is simplified. More typically, various areas of a wellbore are isolated and perforated in order to access different formations that are present at different depths in the wellbore. More importantly, lateral wellbores are now routinely formed from a central wellbore to reach and to follow formations extending from the central wellbore. The lateral wellbores are drilled from the central wellbore and are initiated with the use of a whipstock or some other diverter that can be run into the wellbore in a tubular string and anchored therein. The whipstock includes a slanted or concave area which can guide a cutting tool though the wall of the casing to form a "window" though which a lateral wellbore can be formed. In other instances, casing is run into the central wellbore with a preformed window therein. With the window in place, a new borehole can be formed and with directional drilling techniques, the new wellbore can reach or follow a particular sand or other hydrocarbon bearing formation.

Prior to the well completion techniques described above, wellbores are routinely the subject of a variety of testing designed to determine the characteristics of surrounding formations. The characteristics are indicative of the types of fluids present in formations. One type of testing is performed with a gamma ray tool. A gamma ray tool includes a radiation detector for detecting naturally occurring gamma radiation from a formation. An electrical signal is produced corresponding to each detected gamma ray and the signal has an amplitude representative of the energy of the gamma ray. The detector includes a scintillation crystal or scintillator which is optically coupled to a photomultiplier tube. The scintillator may comprise a gadolinium-containing material, such as gadolinium orthosilicate that is suitably doped, for example with cerium, to activate for use as a scintillator. The quantity of cerium in terms of number of atoms is typically of the order of about 0.1% to about 1% of the quantity of gadolinium. The scintillator may comprise other materials, such as sodium iodide doped with thalium (NaI)(Tl), bismuth germanate, cesium iodide, and other materials.

Another type of logging tool is a neutron tool. Neutron tools are used to analyze fluids in a formation to determine their characteristics. This is especially important where water or some other non-hydrocarbon fluid has migrated into an area adjacent a perforated wellbore. Production of water creates additional expense and necessarily reduces the production of oil at the surface of the well. In order to identify and eliminate water entering a wellbore, the formations around the wellbore are tested using a logging tool such as a neutron tool. The neutron tool emits neutrons into the formation and subsequently recovers the neutrons after they have been deflected by the formation. By counting the number of neutrons returning, the makeup of the fluid can be determined and water, oil and gas can be identified and distinguished. Thereafter, elimination packers can be installed in the wellbore to contain the water. The neutron tool is conventionally run into a well on wireline and the isolation packers are subsequently run in on a tubular string to a location corresponding to the depth at which the logging tool indicated the presence of water.

In the examples above, tubular strings with tools are inserted into a wellbore and lowered to a position of interest based upon previously measured information related to depth and information about formations and fluids therein. The previous measurements are typically performed in an open hole with the logging tools conveyed on wireline. However, during the subsequent process of conveying the tools with tubing or drill-pipe, improper or inaccurate measurements of the length of the drill string may take place due to inconsistent lengths of collars and drill-pipes, pipe stretch, pipe tabulation errors, etc., resulting in erroneous placement of the tools. Thus, the tools may be positioned in the wrong area of the wellbore and the surrounding formations may not be effectively accessed. Repeating the insertion of the tool string may be very costly both in expenses and time.

There is a need therefore, for a method and apparatus to combine some aspects of well logging with some aspect of well completion. There is a further need for methods and apparatus to utilize well logging and downhole tools in a single trip. There is yet a further need for methods and apparatus permitting downhole well completion tools to logged into a wellbore on a run-in string of tubulars along with logging tools to ensure that the downhole tools are positioned at the optimum location in the wellbore. There is yet a further need for methods and apparatus to locate wellbore completion tools in a cased wellbore that more completely utilizes logging data from prior, open hole tests. There is yet a further need for apparatus and methods that includes the run-in of various downhole tools along with various logging tools capable of operating in a cased wellbore in order to locate a zone of interest in real time and place the tools in the optimum place in the wellbore in a single run with no separate power lines extending from the apparatus to the surface of the well.

SUMMARY OF THE INVENTION

Methods and apparatus are provided that permit downhole tools to be run into a well along with logging tools that can log the downhole tools into place by real time transmission of the data to a surface location. In one aspect, an apparatus includes an electromagnetic telemetry tool, a logging tool in communication with the telemetry tool and a downhole tool. In another aspect, the apparatus includes a telemetry tool, a gamma ray tool, and a whipstock and anchor assembly. In yet another aspect, the invention includes a telemetry tool, a gamma ray tool, and at least one packer constructed and arranged to isolate an area of the wellbore. In yet another aspect, a method and apparatus are provided to utilize a telemetry tool, a well logging tool and a perforating gun assembly on a tubular string. In another aspect of the invention a method is provided to log at least one wellbore component into a well using a telemetry tool and a gamma ray tool wherein the real time information from the gamma ray tool is transmitted to the surface of the well where it is compared to a prior log. By comparing the real time information with the historical data, an operator at the surface of the well can identify a moment when the wellbore component is adjacent a particular area of interest. In another aspect of the invention, a neutron tool is run into a cased wellbore along with a telemetry tool and at least one wellbore component like an isolation packer. The neutron tool identifies specific fluids, like water and the packers are used to isolate the area of water.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION

Figure 1:
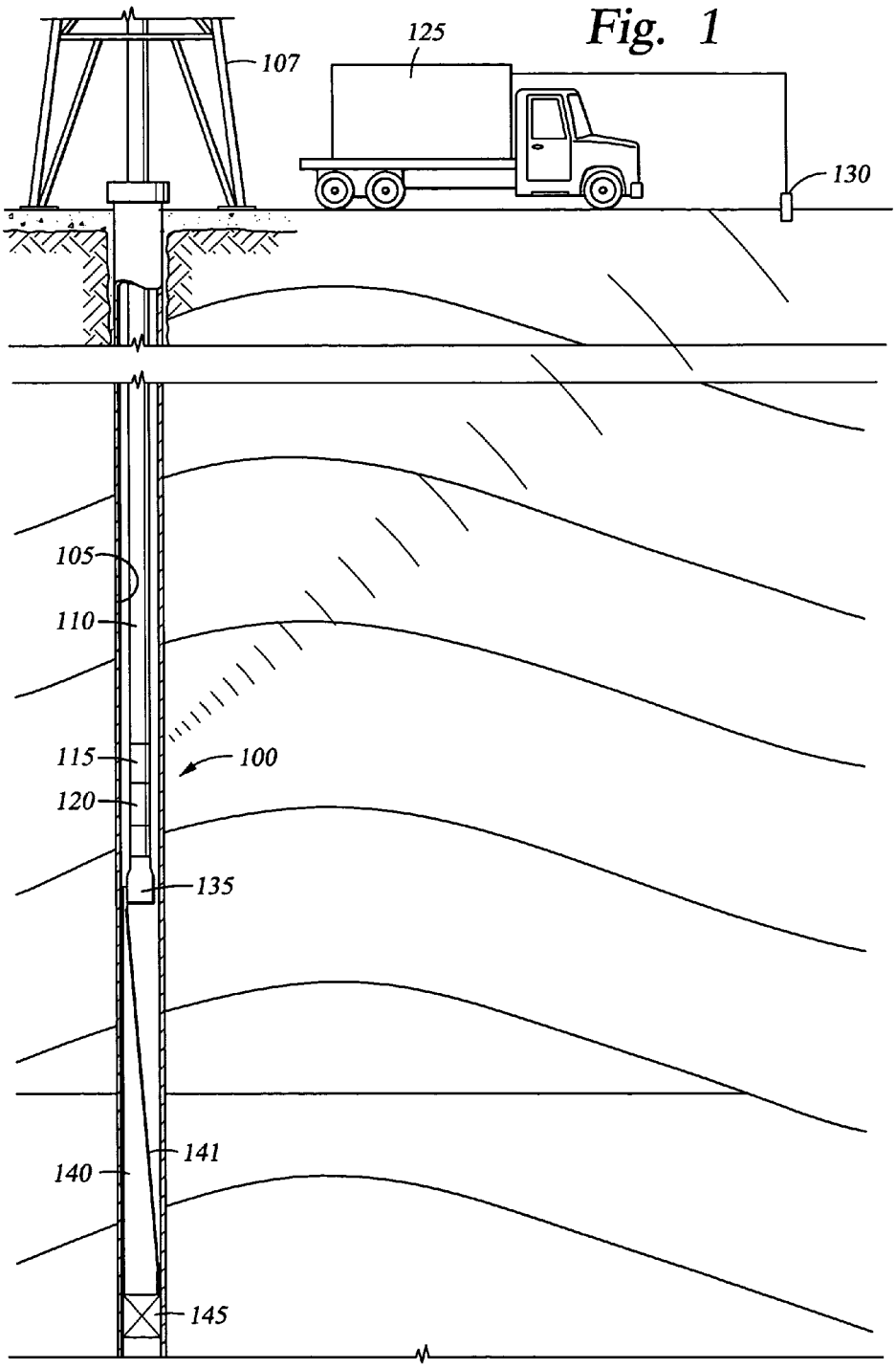
FIG. 1 is a partial section view of a wellbore having a run in string of tubular therein that includes downhole tools as well as a gamma ray tool and a telemetry tool.

FIG. 1 is a partial section view of a wellbore 105 under a drilling platform 107 having an apparatus 100 of the present invention disposed therein. A tubular string 110 includes wellbore components as well as an electromagnetic telemetry tool 115 and a gamma ray tool 120 according to the invention. The gamma ray 120 tool and the electromagnetic telemetry tool 115 instrumentation may be encapsulated in a pressure housing constructed withstand pressures, temperatures and rotational movement associated with a tubular string of drill pipe. The apparatus 100 generally includes a surface unit 125. The surface unit 125 may include one or more processors, computers, controllers, data acquisition systems, signal transmitter/receiver or transceivers, interfaces, power supplies and/or power generators and other components. In one embodiment, the surface unit 125 is housed in a mobile truck. An antenna 130, such as a metal ground stake or other receiving instrumentation may be disposed or driven into the ground and connected to the surface unit 125 to receive and/or transmit signals to and/or from components in the downhole apparatus 100. In one embodiment, the antenna 130 is disposed at about 100 feet (radial distance) away from the surface unit 125 with another electrically conductor path (not shown) from the surface unit 125 to the tubular string 110. The string 110 includes a plurality of drill-pipe or tubing, with the electromagnetic telemetry tool 115 and a gamma ray tool 120 attached thereon.

The apparatus 100 is designed to be precisely located in the wellbore and thereafter form a window (not shown) in casing wall for a lateral wellbore to extend therefrom. The apparatus also includes a milling tool 135 disposed on the tubular string 110. The milling tool is connected to a whipstock 140 by a temporary mechanical connection (not shown). Below the whipstock, an anchor 145 fixes the apparatus in place in the wellbore 105.

The apparatus is constructed and arranged to be lowered into the wellbore 105 to a predetermined axial and rotational position where a window is to be formed. Thereafter, the anchor 146 is set and the apparatus 100 is axially and rotationally fixed in the wellbore. With upper force of the string 110, the temporary connection (typically a shearable connection) between the whipstock 140 and the milling tool 135 is caused to fail. Thereafter, the milling tool 135 is raised and rotated at the end of the string 110. As the rotating mill is lowered, it is urged down the concave portion 141 of the whipstock 140 and forms the window in the wellbore casing 106. The milling tool may then be replaced by a more typical drill bit or in the case of a hybrid bit, can continue into the formation.

With the telemetry tool 115 and gamma ray tool 120 disposed on the tubular string with the wellbore components, the location of the apparatus with respect to wellbore zones of interest can be constantly monitored as the telemetry tool transmits real time information to the surface unit 125. At the surface, the signals are received by the signal processing circuits, which may be of any suitable known construction for encoding and decoding, multiplexing and demultiplexing, amplifying and otherwise processing the signals for transmission to and reception by the surface equipment. The operation of the gamma ray tool 120 is controlled by signals sent downhole from the surface equipment. These signals are received by a tool programmer which transmits control signals to the detector and a pulse height analyzer.

The surface equipment includes various electronic circuits used to process the data received from the downhole equipment, analyze the energy spectrum of the detected gamma radiation, extract therefrom information about the formation and any hydrocarbons that it may contain, and produce a tangible record or log of some or all of this data and information, for example on film, paper or tape. These circuits may comprise special purpose hardware or alternatively a general purpose computer appropriately programmed to perform the same tasks as such hardware. The data/information may also be displayed on a monitor and/or saved in a storage medium, such as disk or a cassette.

The electromagnetic telemetry tool 115 generally includes a pressure and temperature sensor, a power amplifier, a down-link receiver, a central processing unit and a battery unit 290. The electromagnetic telemetry tool 115 is selectively controlled by signals from the surface unit to operate in a pressure and temperature sensing mode, providing for a record of pressure versus time or a gamma ray mode which records gamma counts as the apparatus is raised or lowered past a correlative formation marker. The record of gamma counts is then transmitted to surface and merged with the surface system depth/time management software to produce a gamma ray mini log which is later compared to the wireline open-hole gamma ray log to evaluate the exact apparatus position.

Figure 2:
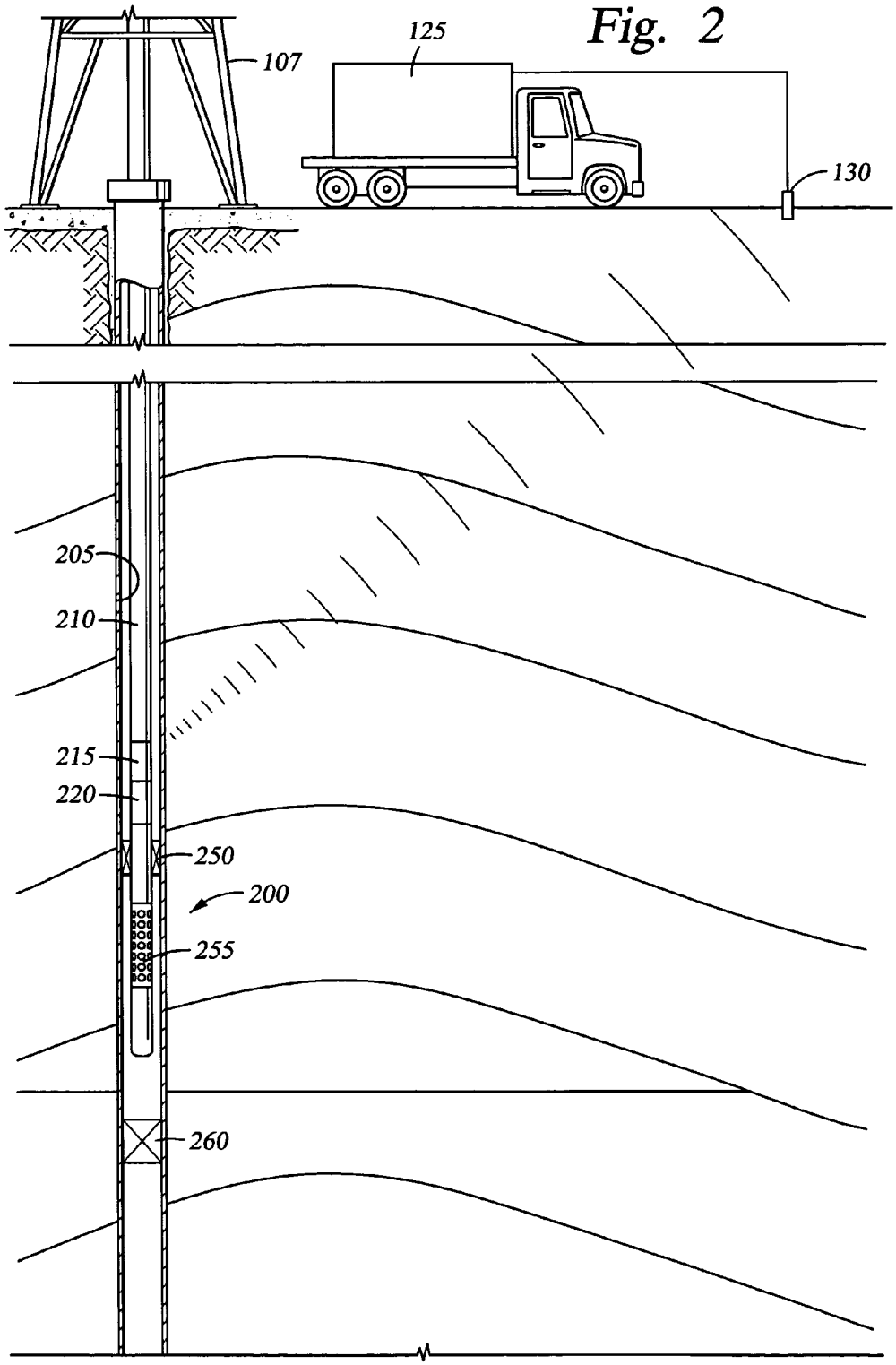
FIG. 2 is a partial section view of a wellbore showing a different combination of downhole tools in use with a gamma ray tools and a telemetry tool.

FIG. 2 is a section view of a wellbore 205 illustrating another embodiment of the invention. Apparatus 200 includes a gamma ray tool 220 and a telemetry tool 215 disposed on a run-in string 210 with a packer 250 therebelow and perforating gun assembly 255 disposed below the packer. Various other components correspond to components of FIG. 1 and are numbered similarly. In use, the apparatus 208 is run into a wellbore 205 and the packer 250 is set at a predetermined location whereby the perforating gun assembly 255 is adjacent that portion of the wellbore casing 106 to be perforated (not shown). At a predetermined time, the perforating gun assembly 255 is fired and shaped charges create perforations in the casing, cement and the formation therearound. In FIG. 2 a bridge plug 260 is shown fixed in the wellbore below the apparatus 200. Typically, a bridge plug is used to further isolate an area of a wellbore to be perforated.

Using a gamma ray and telemetry tool with the apparatus of FIGS. 1 and 2, the operations performed by the various downhole tools can be more precisely carried out because the tools can be more precisely placed in the wellbore. Using the telemetry tool and gamma ray tool on the run-in string and operating these devices in real time, the information transmitted to the surface of the well can be compared to an earlier, open hole log and the comparison used to more precisely place the tools at a desired depth. This method of logging downhole tools into place will be described below:

An apparatus according to those illustrated in FIGS. 1 and 2 includes a downhole system and a surface system. The downhole system includes the apparatus disposed on a string of tubulars. Additionally, the apparatus may include a gamma-ray tool, central processing unit, a modulator, a pre-amplifier, a power amplifier, and a transmitter/receiver. One or more of these components may be housed together with a telemetry tool. The electromagnetic telemetry system including the gamma ray tool is controlled by signals transmitted from the surface system. A command is transmitted from surface to downhole to start recording and storing to memory a record of gamma counts as the apparatus is conveyed up or down past a correlative marker (formation). As time and a conveyed depth measurement is stored at surface by the surface system it is correlated to the downhole gamma counts after being transmitted and a mini gamma ray log is generated. It then can be compared to the wireline open-hole for tubing conveyed depth versus the log depth from the original wireline open-hole log. The apparatus is then positioned up or down relative to the correlated measured depth from the open-hole log.

Communication between the apparatus and the surface system may be achieved through wireless electromagnetic borehole communication methods, such as the Drill-String/Earth Communication (i.e.: D-S/EC) method. The D-S/EC method utilizes the tubing string or any electrical conductor, such as the casing or tubing and the earth as the conductor in a pseudo-two-wire-transmission mode.

The surface system 530 includes a receiving antenna, a surface transmitter/receiver, a preamplifier/filter, a demodulator, a digital signal processor, a plurality of input/output connections or I/O, and a controller. The controller includes a processor, and one or more input/output devices such as, a display (e.g. Monitor), a printer, a storage medium, keyboard, mouse and other input/output devices. A power supply and a remote control may also be connected to the input/output.

To begin the logging into place method, the apparatus is conveyed downhole into the wellbore with the electromagnetic telemetry tool and gamma ray tool. A plurality of drill pipes or tubings are connected onto the tubular string until the measured depth is reached. As the string is lowered into the wellbore past the prospective correlative formation, the apparatus is stopped and a downlink command from the surface system is sent ordering the gamma ray tool to start recording data to memory. The apparatus is then raised, for example, at a rate of approximately 5 meters per minute, to record gamma counts as the gamma ray tool passes by differing lithologies. After a distance of approximately 30 meters has logged, the complete record of downhole gamma counts is transmitted to surface. A partial log (or mini log) is generated by merging the recorded surface depth/time records with the downhole gamma count record. The partial log is then compared to a previously produced well log (e.g., open-hole gamma-ray log) and correlated to the same marker formation. As the open hole gamma-ray log is considered correct, a depth position adjustment, if necessary, is calculated based on the comparison of the partial log to the open hole gamma-ray log. The tubular string is moved up or down by adding or removing drill pipe(s) or tubing(s) to adjust the position of the apparatus. After the apparatus has been logged into place at a correct depth, the downhole components may be set or actuated.

The apparatus and methods described herein permit a more exact placement of downhole tools in a wellbore without the use of hard-wired communications with the surface of the well.

While the methods according to the invention have been described with the use of a gamma ray tool, it will be understood that the methods can also be performed using a neutron tool in place of the gamma ray tool or with the gamma ray tool. The neutron tool is usable with the same type of surface system and according to the methods described herein. When operating a downhole apparatus including a neutron tool, the apparatus would typically be moved between 200 and 3600 feet per hour with the neutron tool admitting a rapid frequency. Typically, the apparatus with the neutron tool would be lowered into the wellbore and then the neutron tool would be operated as the apparatus is pulled upward in the wellbore towards the surface.

Additionally, the logging tool may be a device intended to identify a certain location in the wellbore. For example, a collar locator could be used to communicate a depth position of an apparatus in a wellbore to the surface of the well. One type of collar locator is an electromechanical device whereby spring-loaded arms with axial wheel members are disposed on the inside of the casing or on the outer surface of a tubular string carrying the apparatus. As the spring-loaded arms pass by a tubing coupling, mechanical movement is translated into an electric signal through communication between the collar locator and the telemetry tool. Thereafter, the telemetry tool transmits a wireless message to the surface unit that a coupling has been contacted. Another type of collar locator is a magnetic proximity sensor. These sensors can detect a change in metal mass which is indicative of a coupling between strings of tubular. These proximity sensors could also be in communication with the telemetry tool of an apparatus to transmit information about the location of couplings in a wellbore to the surface of the well. Radioactive tag locators can work in a similar fashion. The locators can be placed in casing string or in portions of an apparatus and consist of small pieces of radioactive material. When the material passes by a sensor, there is a signal generated by the contact of the two materials. Through communication with the telemetry tool, this signal information can be transmitted to the surface of the well. Finally, a radio frequency tag can be used locate couplings in a tubular string with respect to depth in a wellbore. A "RF tag" is essentially a bar code symbol which is read by a reader. The reader can be placed either on the apparatus run into the wellbore or on the inside surface of the casing.

While the foregoing is directed to the preferred embodiment of the present invention, other and further embodiments of the invention may be devised without departing from the basic scope thereof, and the scope thereof is determined by the claims that follow.

What is claimed is:

1. An apparatus for performing a wellbore operation, comprising:

a transmitter for wireless conveyance of information to a surface system;

a radio frequency reader in communication with the transmitter;

a wellbore component positioned in the wellbore by using information provided by the radio frequency reader.

2. The apparatus of claim 1, wherein the wellbore component is selected from the group consisting of a packer, a bridge plug, perforating gun and combinations thereof.

3. The apparatus of claim 1, wherein the surface system is configured to analyze, consolidate and present data collected by the radio frequency reader.

4. The apparatus of claim 1, wherein the radio frequency reader is configured for communicating with radio frequency identification tags.

5. The apparatus of claim 1, further comprising a memory for storing data pertaining to the characteristics of formations surrounding the wellbore.

6. The apparatus of claim 1, further comprising a central processing unit.

7. The apparatus of claim 1, further comprising:

a memory for storing data pertaining to the characteristics of formations surrounding the wellbore; and a central processing unit coupled to the memory.

* * * * *